US008085018B2

(12) United States Patent
Nihei et al.

(10) Patent No.: US 8,085,018 B2
(45) Date of Patent: Dec. 27, 2011

(54) VOLTAGE REGULATOR WITH PHASE COMPENSATION

(75) Inventors: Yotaro Nihei, Chiba (JP); Takashi Imura, Chiba (JP); Tadashi Kurozo, Chiba (JP)

(73) Assignee: Seiko Instruments Inc. (JP)

( * ) Notice: Subject to any disclaimer, the term of this patent is extended or adjusted under 35 U.S.C. 154(b) by 383 days.

(21) Appl. No.: 12/455,558

(22) Filed: Jun. 3, 2009

(65) Prior Publication Data

US 2009/0302811 A1 Dec. 10, 2009

(30) Foreign Application Priority Data

Jun. 9, 2008 (JP) ..... 2008-150926

(51) Int. Cl.
*G05F 1/575* (2006.01)

(52) U.S. Cl. ..... 323/280; 323/273

(58) Field of Classification Search ..... 323/273, 323/280

See application file for complete search history.

(56) References Cited

U.S. PATENT DOCUMENTS

| | | | | |
|---|---|---|---|---|
| 5,686,820 | A * | 11/1997 | Riggio, Jr. | 323/273 |
| 6,049,200 | A * | 4/2000 | Hayashimoto | 323/269 |
| 6,828,763 | B2 * | 12/2004 | Sudou et al. | 323/226 |
| 6,856,123 | B2 * | 2/2005 | Takabayashi | 323/273 |
| 7,208,924 | B2 * | 4/2007 | Toyoshima et al. | 323/271 |
| 7,956,588 | B2 * | 6/2011 | Imura | 323/274 |
| 2001/0011886 | A1 * | 8/2001 | Kobayashi | 323/281 |
| 2001/0028240 | A1 * | 10/2001 | Fukui | 323/280 |
| 2005/0088153 | A1 * | 4/2005 | Suzuki | 323/274 |
| 2005/0162141 | A1 * | 7/2005 | Kanakubo | 323/274 |
| 2009/0302811 | A1 * | 12/2009 | Nihei et al. | 323/217 |
| 2010/0253431 | A1 * | 10/2010 | Fujiwara | 330/253 |
| 2010/0289464 | A1 * | 11/2010 | Yamamoto et al. | 323/280 |

* cited by examiner

*Primary Examiner* — Jeffrey Sterrett
(74) *Attorney, Agent, or Firm* — Adams & Wilks

(57) ABSTRACT

Provided is a voltage regulator capable of performing appropriate phase compensation. Even when a difference between an input voltage and an output voltage is small, an appropriate phase compensation voltage based on an output voltage (Vout) is generated in a resistor circuit (19), and the appropriate phase compensation voltage is applied to a phase compensation capacitor (20). Accordingly, the voltage regulator is capable of performing appropriate phase compensation.

3 Claims, 2 Drawing Sheets

VOLTAGE REGULATOR WITH PHASE COMPENSATION

BACKGROUND OF THE INVENTION

1. Field of the Invention

The present invention relates to a voltage regulator.

2. Description of the Related Art

A voltage regulator includes a phase compensation circuit for stable operation.

FIG. 4 is a circuit diagram of a conventional voltage regulator including a phase compensation circuit.

When an output voltage Vout increases, a divided voltage Vfb also increases. When the divided voltage Vfb becomes higher than a reference voltage Vref, an output voltage of a differential amplifier circuit 76 increases. Accordingly, a gate voltage of an output transistor 73 increases, and a drain current of the output transistor 73 decreases, whereby the output voltage Vout decreases. As a result, the output voltage Vout is controlled to be a desired constant voltage. On this occasion, a gate voltage of a sense transistor 77 also increases, and thus a drain current of the sense transistor 77 also decreases. For this reason, a current flowing through a resistor 78 decreases, with the result that a voltage generated in the resistor 78 also decreases. Through a change in voltage applied to a phase compensation capacitor 79 as described above, phase compensation is performed.

In this case, the divided voltage Vfb is a voltage obtained by superimposing a phase compensation signal which is sent from the differential amplifier circuit 76 via the sense transistor 77 and the phase compensation capacitor 79 back to the differential amplifier circuit 76 on a signal which is sent from the differential amplifier circuit 76 via the output transistor 73 and a voltage divider circuit 74 back to the differential amplifier circuit 76.

Even when the output voltage Vout decreases, the output voltage Vout is controlled to be a desired constant voltage as in the case of the above. On this occasion, phase compensation is performed as in the case of the above (for example, see JP 2005-316788 A).

However, in the conventional voltage regulator, when a difference between an input voltage and an output voltage is small, a voltage between a source and a drain of the sense transistor 77 becomes small depending on a condition of a load, and in some cases, the sense transistor 77 operates in non-saturation while the output transistor 73 operates in saturation. As a result, fluctuations in drain voltage of the sense transistor 77 do not coincide with fluctuations in drain voltage of the output transistor 73. Phase compensation is performed based on the drain voltage of the sense transistor 77, and hence, the phase compensation is inappropriately performed.

SUMMARY OF THE INVENTION

The present invention has been made in view of the above-mentioned problem, and therefore provides a voltage regulator capable of performing appropriate phase compensation.

In order to solve the above-mentioned problem, a voltage regulator according to the present invention comprises: an output transistor; a voltage divider circuit; a differential amplifier circuit; an amplifier circuit provided between the differential amplifier circuit and the output transistor; a current supply circuit that is connected to an output terminal of the differential amplifier circuit and supplies a phase compensation current; a resistor circuit that generates a phase compensation voltage based on the phase compensation current; and a phase compensation capacitor that is provided between the resistor circuit and an output terminal of the voltage divider circuit and performs phase compensation based on the phase compensation voltage and a divided voltage.

According to the present invention, even when a difference between an input voltage and an output voltage is small, an appropriate phase compensation voltage based on an output voltage of the voltage regulator is generated in the resistor circuit, and is applied to the phase compensation capacitor. Accordingly, the voltage regulator is capable of performing the appropriate phase compensation.

DETAILED DESCRIPTION OF THE PREFERRED EMBODIMENT

Hereinafter, an embodiment of the present invention is described with reference to the drawings.

Figure 1:
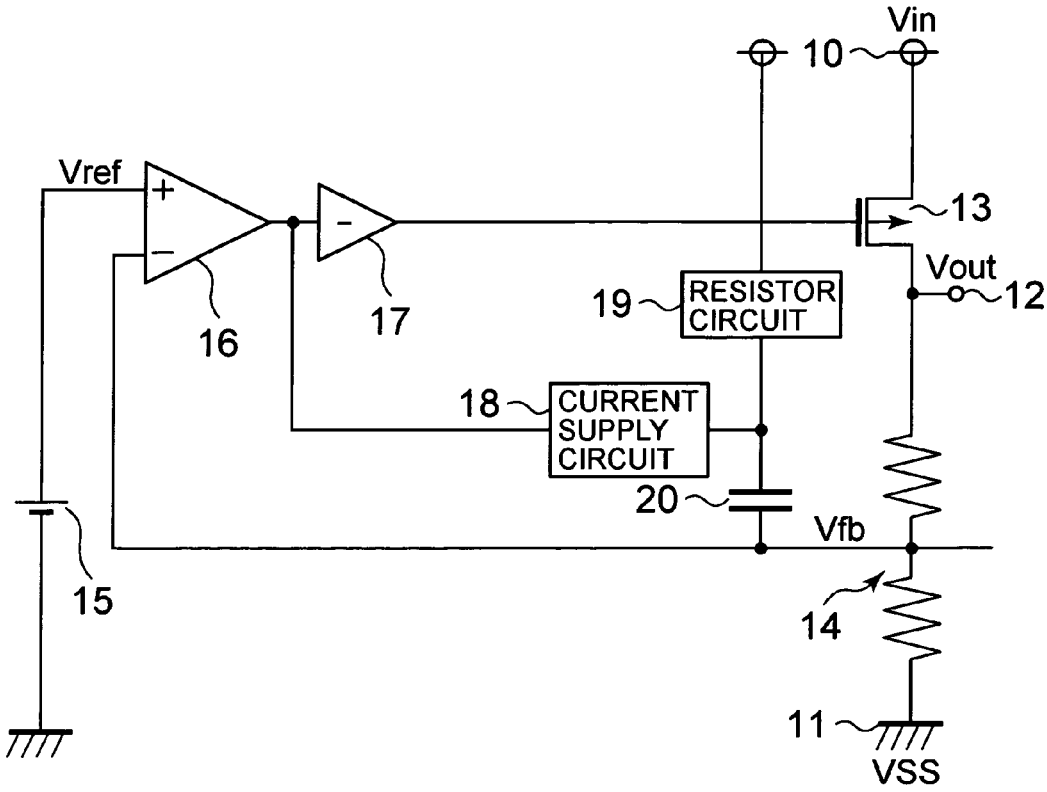
FIG. 1 is a circuit diagram illustrating an outline of a voltage regulator according to the present invention.
Figure 2:
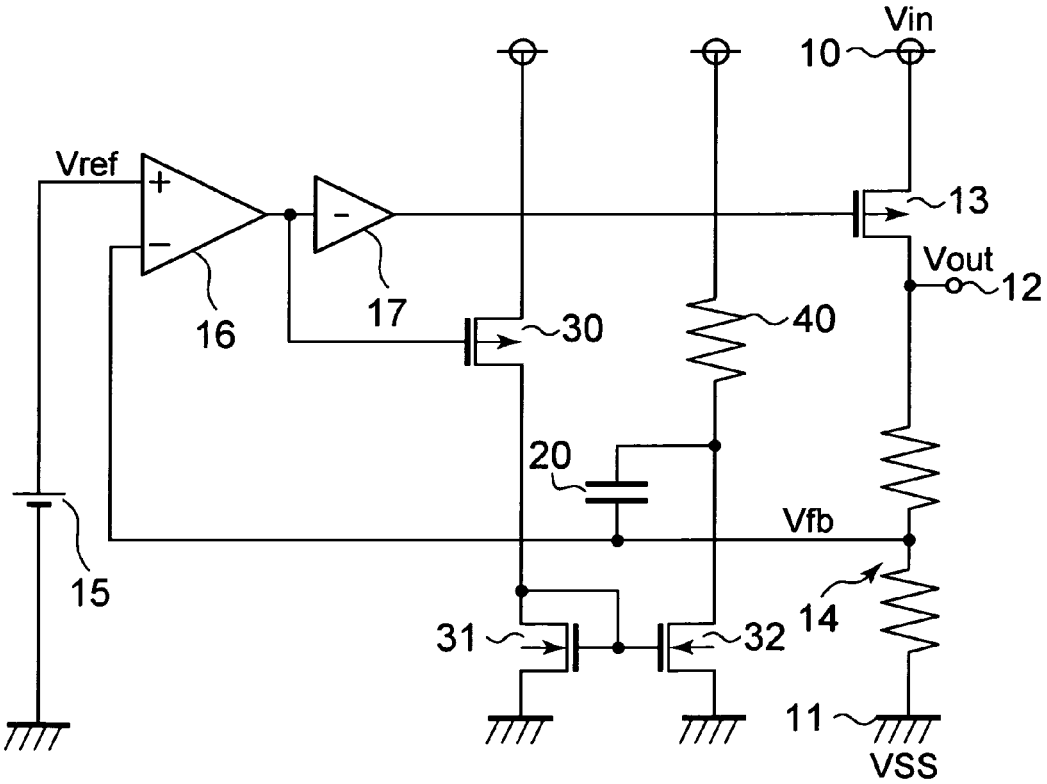
FIG. 2 is a circuit diagram illustrating a current supply circuit and a resistor circuit of the voltage regulator according to an embodiment of the present invention.

First, a configuration of a voltage regulator is described. FIG. 1 is a circuit diagram illustrating the voltage regulator. FIG. 2 is a circuit diagram illustrating a current supply circuit and a resistor circuit.

The voltage regulator includes an input terminal 10, a ground terminal 11, and an output terminal 12. The voltage regulator further includes an output transistor 13, a voltage divider circuit 14, a reference voltage generation circuit 15, a differential amplifier circuit 16, an amplifier circuit 17, a current supply circuit 18, a resistor circuit 19, and a phase compensation capacitor 20.

The output transistor 13 has a gate connected to an output terminal of the amplifier circuit 17, a source connected to the input terminal 10, and a drain connected to the output terminal 12. The voltage divider circuit 14 is provided between the output terminal 12 and the ground terminal 11. The differential amplifier circuit 16 has a non-inverting input terminal connected to an output terminal of the reference voltage generation circuit 15, and an inverting input terminal connected to an output terminal of the voltage divider circuit 14. The amplifier circuit 17 has an input terminal connected to an output terminal of the differential amplifier circuit 16. The current supply circuit 18 has an input terminal connected to the output terminal of the differential amplifier circuit 16, and an output terminal connected to a connection point between the resistor circuit 19 and the phase compensation capacitor 20. The phase compensation capacitor 20 is provided between a connection point between the current supply circuit 18 and the resistor circuit 19, and the output terminal of the voltage divider circuit 14.

The current supply circuit 18 includes a PMOS transistor 30 and NMOS transistors 31 and 32.

The PMOS transistor 30 has a gate connected to the output terminal of the differential amplifier circuit 16, and a source connected to the input terminal 10. The NMOS transistor 31 has a gate and a drain which are connected to a drain of the PMOS transistor 30, and a source connected to the ground terminal 11. The NMOS transistor 32 has a gate connected to the gate and the drain of the NMOS transistor 31, a source connected to the ground terminal 11, and a drain connected to a connection point between a resistor 40 and the phase compensation capacitor 20. In other words, the NMOS transistors 31 and 32 are current-mirror-connected to each other.

The resistor circuit 19 includes the resistor 40.

The resistor 40 is provided between the input terminal 10, and a connection point between the drain of the NMOS transistor 32 and the phase compensation capacitor 20.

The output transistor 13 outputs an output voltage Vout based on an output voltage of the amplifier circuit 17 and an input voltage Vin. The voltage divider circuit 14 receives and divides the output voltage Vout, and outputs a divided voltage Vfb. The reference voltage generation circuit 15 generates a reference voltage Vref. The differential amplifier circuit 16 controls the output transistor 13 based on the divided voltage Vfb and the reference voltage Vref so that the output voltage Vout becomes a desired constant voltage. The amplifier circuit 17 receives and amplifies an output voltage of the differential amplifier circuit 16, and outputs an output voltage. The current supply circuit 18 supplies a phase compensation current based on the output voltage of the differential amplifier circuit 16. The resistor circuit 19 generates a phase compensation voltage based on the phase compensation current. The phase compensation capacitor 20 performs phase compensation based on the divided voltage Vfb and the phase compensation voltage.

The PMOS transistor 30 supplies the phase compensation current based on the output voltage of the differential amplifier circuit 16 and the input voltage Vin. The phase compensation current flows into a current mirror circuit formed of the NMOS transistors 31 and 32, and thus, a current of the same amount as that of the phase compensation current is drawn from the resistor 40 through the current mirror. The resistor 40 generates the phase compensation voltage based on the phase compensation current.

In this case, the current flowing through the PMOS transistor 30 and the current flowing through the resistor 40 are controlled by the output voltage of the differential amplifier circuit 16, thereby being limited to a predetermined value or less.

In a case where the output transistor 13 operates in saturation, the PMOS transistor 30 and the NMOS transistors 31 and 32 are capable of operating based on the output voltage Vout, with the result that the resistor 40 is also capable of generating a phase compensation voltage based on the output voltage Vout. That is, there occurs no phenomenon in which a sense transistor operates in non-saturation and the phase compensation voltage is not based on the output voltage Vout as in a conventional case.

Next, an operation of the voltage regulator is described.

When the output voltage Vout increases, the divided voltage Vfb also increases. When the divided voltage Vfb becomes higher than the reference voltage Vref, an increased amount with respect to the reference voltage Vref is amplified, and the output voltage of the differential amplifier circuit 16 decreases. Then, a decreased amount thereof is inverted and amplified, whereby the output voltage of the amplifier circuit 17 increases. As a result, a gate voltage of the output transistor 13 also increases, and the output transistor 13 is gradually turned off, whereby the output voltage Vout decreases. Accordingly, the output voltage Vout is controlled to be a desired constant voltage. On this occasion, based on the output voltage of the differential amplifier circuit 16, the current supply circuit 18 supplies the phase compensation current to the resistor circuit 19. The resistor circuit 19 generates the phase compensation voltage based on the phase compensation current. The phase compensation voltage and the divided voltage Vfb are applied to one end and the other end of the phase compensation capacitor 20, respectively, with the result that phase compensation is performed.

Here, the divided voltage Vfb is a voltage obtained by superimposing a phase compensation signal which is sent from the differential amplifier circuit 16 via the current supply circuit 18 and the phase compensation capacitor 20 back to the differential amplifier circuit 16 on a signal which is sent from the differential amplifier circuit 16 via the amplifier circuit 17, the output transistor 13, and the voltage divider circuit 14 back to the differential amplifier circuit 16.

Even when the output voltage Vout decreases, the output voltage Vout is controlled to be a desired constant voltage as in the case of the above. On this occasion, phase compensation is performed as in the case of the above.

In the manner described above, even when a difference between an input voltage and an output voltage is small, an appropriate phase compensation voltage which is based on the output voltage Vout is generated in the resistor circuit 19, and the appropriate phase compensation voltage is applied to the phase compensation capacitor 20, with the result that the voltage regulator is capable of performing appropriate phase compensation. Accordingly, the voltage regulator is resistant to oscillating, and thus is capable of operating in a stable manner.

Figure 3:
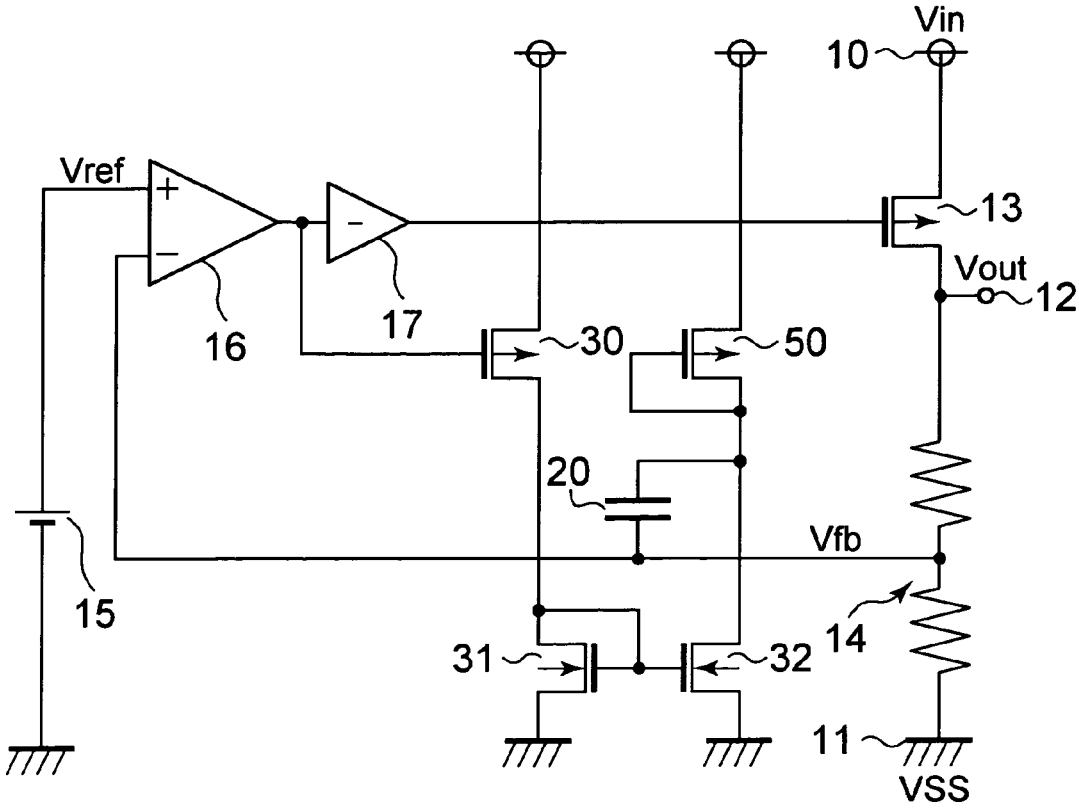
FIG. 3 is a circuit diagram illustrating the current supply circuit and another resistor circuit of the voltage regulator according to the present invention.
Figure 4:
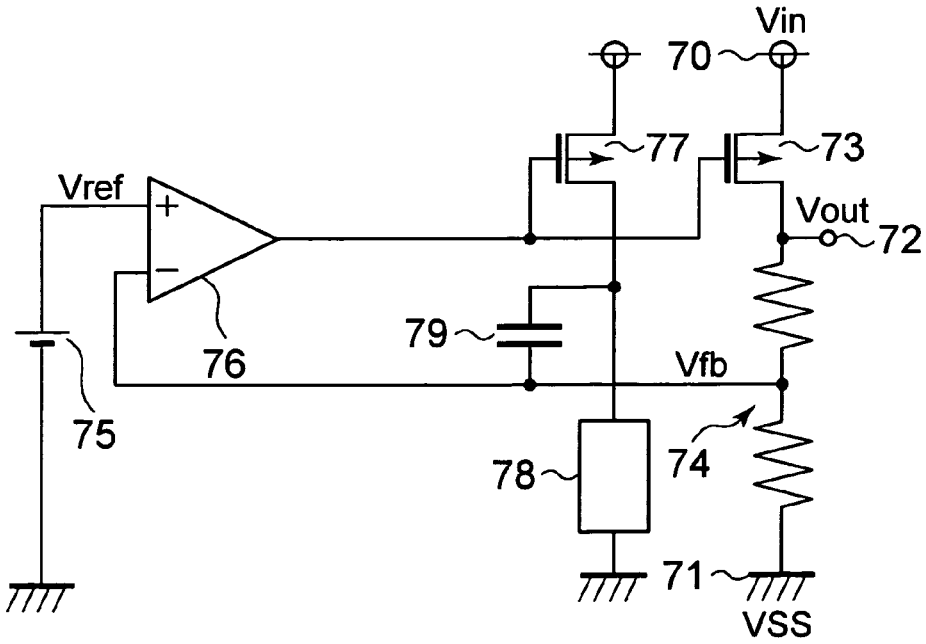
FIG. 4 PRIOR ART
FIG. 4 is a circuit diagram illustrating a conventional voltage regulator.

In FIG. 2, the resistor 40 is provided between the input terminal 10, and the connection point between the drain of the NMOS transistor 32 and the phase compensation capacitor 20. However, as illustrated in FIG. 3, the resistor 40 may be eliminated, and there may be provided a PMOS transistor 50 which has a gate and a drain connected to the connection point between the drain of the NMOS transistor 32 and the phase compensation capacitor 20 and a source connected to the input terminal 10, and is diode-connected.

18 current supply circuit

19 resistor circuit

What is claimed is:

1. A voltage regulator, comprising:

an output transistor;

a voltage divider circuit that divides a voltage output from the output transistor and outputs a divided voltage;

a differential amplifier circuit that amplifies a difference between the divided voltage and a reference voltage, and outputs the amplified difference, to thereby control a gate of the output transistor;

an amplifier circuit provided between the differential amplifier circuit and the output transistor;

a current supply circuit that is connected to an output terminal of the differential amplifier circuit and supplies a phase compensation current;

a resistor circuit that generates a phase compensation voltage based on the phase compensation current; and a phase compensation capacitor that is provided between the resistor circuit and an output terminal of the voltage divider circuit and performs phase compensation based on the phase compensation voltage and the divided voltage.

2. A voltage regulator according to claim 1, wherein the current supply circuit comprises a first transistor that has a gate controlled by an output voltage of the differential amplifier circuit.

3. A voltage regulator according to claim 1, wherein the resistor circuit comprises a second transistor that has a gate and a drain connected to each other.

* * * * *